US005099975A

United States Patent [19]

Ullman et al.

[11] Patent Number: 5,099,975

[45] Date of Patent: * Mar. 31, 1992

[54] DOLLAR SLOT FOR COIN CONTROL MECHANISM FOR USE WITH A PERIODICAL DISPENSING DEVICE

[75] Inventors: Ralph J. Ullman; Eugene Kazmir, both of Shiner, Tex.

[73] Assignee: Kaspar Wire Works, Inc., Shiner, Tex.

[ * ] Notice: The portion of the term of this patent subsequent to May 9, 2006 has been disclaimed.

[21] Appl. No.: 490,762

[22] Filed: Mar. 8, 1990

Related U.S. Application Data

[63] Continuation-in-part of Ser. No. 200,076, May 27, 1988, Pat. No. 4,915,206.

[51] Int. Cl.[5] ..... G07F 5/08

[52] U.S. Cl. ..... 194/227; 194/345

[58] Field of Search ..... 194/226, 227, 345

[56] References Cited

U.S. PATENT DOCUMENTS

| | | | |
|---|---|---|---|
| 3,797,626 | 3/1974 | Albright | 194/227 |
| 4,037,701 | 7/1977 | Knickerbocker | 194/227 |
| 4,509,633 | 4/1985 | Chow | 194/334 |
| 4,592,461 | 6/1986 | Friedman et al. | 194/227 |
| 4,828,097 | 5/1989 | Kresta et al. | 194/227 |

*Primary Examiner*—F. J. Bartuska

*Attorney, Agent, or Firm*—Gunn Lee & Miller

[57] ABSTRACT

A coin control mechanism for use with a periodical dispensing device, the device comprising a first coin chute capable of allowing the passage of nickel, dime, and quarter denomination coins therethrough but which rejects dollar coins, a second coin chute capable of allowing passage of dollar coins therethrough; a diverter in the first coin chute, weight and size responsive, and will reject dollar coins into the second coin chute; and levers (704) and (242), responsive to the passage of coins through the two coin chutes, to operate the totalizer (268) to advance the totalizer from a non-dispensing position to a predetermined dispensing position as coins pass through the chutes.

8 Claims, 10 Drawing Sheets

DOLLAR SLOT FOR COIN CONTROL MECHANISM FOR USE WITH A PERIODICAL DISPENSING DEVICE

This is a continuation-in-part of copending application Ser. No. 07/200,076 filed on May 27, 1988 now U.S. Pat. No. 4,915,206.

This application incorporates by reference the specifications and drawings of: U.S. Pat. No. 4,037,701 ('701 patent), Knickerbocker 1977. For the sake of clarification, all new structure added to the preceding references begins with the numeral 700.

BACKGROUND OF THE INVENTION

1. Field of the Invention

A coin control mechanism for use in combination with a periodical dispensing device. The mechanism includes a totalizer means reactive to coins fed through a single coin slot. More particularly, the coin mechanism includes a dual coin chute mechanism wherein a first chute is receptive to nickel, dime, and quarter coins but rejects dollar coins into a second chute. Both coin chutes are operatively engaged with the totalizer means to totalize the denominations of coins which pass therethrough such that when said total reaches a predetermined maximum, engagement means allows access to the periodical dispenser.

2. Background

Prior to the introduction of the U.S. and Canadian dollar coins, single slot coin mechanisms were designed to accept the nickel, dime, and quarter denominations of U.S. coins. With the increase in price of papers and with the recent introduction of dollar coins such as the "Loon" coin in Canada and the Susan B. Anthony dollar in the United States, most coin control mechanisms have required redesign in order to accept the dollar coin. However, it is desirous to design the dollar coin reception function into coin control mechanisms with dimensions such that they are capable of being retrofitted into existing periodical dispensers. That is, the general dimensions of the coin control mechanism are fixed by the periodical container, existing coin control mechanisms, and the related latch mechanism, and the dollar accepting function and structure should be contained within and incorporated into pre-existing three-function (nickel, dime, quarter) coin control mechanisms.

One such three-function coin control mechanism is described in the '701 patent. The '701 patent describes a coin control mechanism comprised, in part, of an actuator means, with the actuator means and a totalizer means operatively connected to a coin chute to calculate the cumulative value of coins inserted into the mechanism, a latch control means to control movement of the access door, an adjustable price setter means to present the price necessary to operate the mechanism, a totalizer control means, a totalizer release and reset means to release the totalizer control means in reset the latch control means, and a coin chute means including an actuator control means to control the incremental advance of the totalizer means as coins pass through the coin chute.

Coin control mechanisms such as the one illustrated in the '701 patent that were designed prior to the date of introduction of dollar coins were generally designed for the receipt of coins of three denominations—nickel, dime, and quarter. However, with the introduction of the dollar coin came the need for adapting coin control mechanisms to receive dollar coins.

One mechanism for adapting pre-existing coin control mechanisms to accept dollar coins is to provide for a second coin slot. That is, the consumer would insert coins of one denomination into one slot, and coins of another denomination into a second slot. One such patent is U.S. Pat. No. 3,884,330 (Chalabian 1975) which discloses a coin operated vending machine in which the coin sorting mechanism comprises a pair of chutes for receiving coins from a pair of slots into which they are inserted by the consumer. This invention relates to a mechanically operated mechanism which is actuated by coins of predetermined diameters, such as nickels, dimes, and quarters, so that when the proper number of coins has been inserted in the machine, it will release a latching mechanism to allow the consumer access to the periodicals.

U.S. Pat. No. 4,227,604 (Chalabian 1980) discloses a similar two-slot, two-chute configuration with the addition of a discrimination device at the top of each of the coin chutes, which discrimination device routes coins larger than a certain diameter into the descending coin chute and routes coins smaller than a certain diameter into a coin return passage. That is, the '604 patent provides a coin selection funnel for conducting the inserted coins from the coin slot to the coin chute which passes quarters, but which rejects pennies, nickels, and dimes by short-circuiting them around the coin chute to the coin return box. Upon reaching an aperture, the coins to be rejected are no longer supported by the wall of the funnel, while the coins to be accepted continue to be supported by the portion of the walls of the funnel that lie above the upper edges of the aperture. A deflector is mounted within the trough and it operates to throw the inserted coins against the wall of the aperture.

Another multiple coin chute mechanism is disclosed in U.S. Pat. No. 4,747,478 (Friedman 1988). Friedman discloses a coin sorter for sorting coins of different denomination by means of ramps and flaps, with the sorted coins being directed to different chutes, there being one chute provided for each denomination of coin. The chutes are diameter-responsive to coins of various denominations. The ramps, chutes, and coin exit openings at the end of the chutes are formed into complementary parts of the coin sorter.

Another multiple chute coin mechanism is disclosed in U.S. Pat. No. 4,693,357 (Aschenbeck 1987), assigned to assignee of the present invention. Aschenbeck discloses a coin mechanism for a dispensing machine which includes two or more rectangular chutes for receiving and retaining a given number of coins. Two generally vertical coin chutes receive coins of a predetermined dimension, the chutes having a width and thickness greater than the width and thickness of the coins. A gate is mounted in the mechanism above the chutes and is movable between a first and second gate position for directing coins into one or the other of the two chutes. The gate is operable in a first position to direct coins into the first chute, and operable in a second position to direct coins into the second chute. A rocker arm is mounted adjacent to the first chute for movement between the first and second position. A predetermined number of coins of a predetermined dimension will stack up in the first chute and the top coin in the stack when positioned adjacent to an arm, will position and maintain the gate in the second position directing coins into the second chute.

However, none of the prior art suggests the addition of a secondary coin chute and diverting means for diverting a coin received from a primary coin slot to the secondary chute, which diversion is done through a weight and size responsive means. Moreover, none of the prior art suggests the addition of a second chute vertically aligned to conform with the plane of the primary chute, in lying adjacent to the primary chute, which secondary chute is capable of receiving only coins of one dollar denomination. The dollar receiving secondary coin chute is adapted and dimensioned to easily provide retrofit capabilities to the existing '701 coin control mechanism.

Moreover, none of the prior art provides for a primary coin chute mechanism which is capable of receiving coins of four denominations with a diverting means which allows the passage of nickel, dime, quarter coins but diverts the dollar coins into a secondary chute, a chute into which the nickels, dimes, and quarters never enter.

DESCRIPTION OF THE PREFERRED EMBODIMENT

The present invention relates to an improved coin chute means comprising dual coin chutes; a primary chute located vertically below a single coin slot for the receipt of all coins and a secondary chute lying adjacent to and in the same plane as the primary chute to receive the dollar coins. These dollar coins are "kicked out" of the primary chute by a cradle located immediately adjacent to the coin slot. The dollar coin's passage through the secondary coin chute engages an actuator control means of the secondary coin chute to control the incremental advance of the totalizer means.

Therefore, it is an object of this invention to provide for a coin control mechanism capable of receiving coins of various denominations including a coin of one dollar denomination.

It is a further the object of the present invention to provide for a coin control mechanism capable of receiving nickel, dime, quarter, and one dollar coins through a single slot.

It is a further object of the present invention to provide for a coin control mechanism with dual coin chutes in operative association with a single coin slot.

It is a further object of the present invention to provide for a coin control mechanism with a primary and a secondary chute, which primary chute receives coins of all four denominations (nickel, dime, quarter, dollar) but which is operatively associated with a secondary coin chute to direct dollar coins thereinto.

It is a further object of the present invention to provide for a coin control mechanism with a single slot, and a primary and a secondary coin chute, which primary coin chute passes nickel, dime and quarter denomination coins therethrough and which secondary coin chute receives and passes dollar coins therethrough, which chutes are in operative association with a totalizer means to incrementally advance the totalizer means from a non-dispensing position to a dispensing position, said dispensing position being preselected by the vendor.

It is a further object of this invention to provide a coin control mechanism for operation of a periodical dispensing machine, which coin control mechanism has a single coin slot capable of receiving nickel, dime, quarter and one dollar denomination coins, which coin control mechanism is further capable of having preselected lower, middle and upper limits which lower, middle and upper limits define predetermined coin combinations required to activate the dispensing machine.

It is a further object of this invention to provide for a secondary coin chute capable of receiving dollar coins which have been diverted from a primary coin chute capable of receiving coins of all denominations, which dollar chute has secondary advancing means in operative association therewith for advancing the totalizer towards a predetermined engagement position from a pre-engagement position, in which the advancing means operate separately from a primary advancing means, functionally similar, of the primary coin chute.

These and other objects will become more apparent with specific reference to the specifications and claims as set forth more fully below.

DETAILED DESCRIPTION OF THE PREFERRED EMBODIMENT

As this invention incorporates by reference the '701 patent and the two referenced U.S. applications, applicant will, for clarity, enumerate most of the additional structural elements added to the Knickerbocker patent, or the structural elements disclosed herein, which are modified from the Knickerbocker reference by utilizing numerals beginning with 700. It is hoped that this convention will make it easier for the reader to follow the specifications and understand the novelty of the present invention, and the manner in which the present invention relates to the coin control mechanisms disclosed by the '701 patent and the referenced applications.

Figure 9:
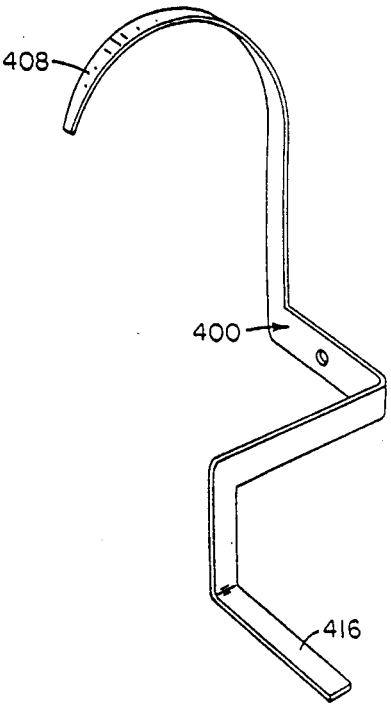
FIG. 9 is a perspective of the bypass removed from the coin control mechanism.

Structurally, this invention adds to the '701 patent bypass (400), illustrated in FIG. 9 apart from coin control mechanism (52). The function of bypass (400) is to permit a third price setting limit means for coin control mechanism (52). Frequently, periodical dispensing device (10) will carry papers of different prices at different times. For example, the daily edition of a newspaper may be one price, the Saturday edition a second price, and the Sunday edition, "Special" or "Extra" editions a third price. By using bypass (400) and the structure operatively associated therewith, as more fully set forth below, three different price setting limits are available to the vendor.

Bypass (400) is illustrated in FIG. 9. It includes interact member (416) and curved portion (408). The paragraphs below will set forth additional structure and the general mode of operation. The section entitled "Operation of Bypass" will specifically describe its function.

The position of bypass (400) and its structural relationship to other elements is shown in FIGS. 10, 12, 13, 14, 15, and 16. Spring (402) biases interact member (416) of bypass (400) against linkage (282). Price setter control means (48) is connected to linkage (282). Bypass (400) is actuated by rotating key means in price setter control means (48), causing rotation of linkage (282). This interaction between linkage (282) and bypass (400) is more clearly set forth in FIGS. 13, 14, 15 and 16. This rotation of linkage (282) by rotation of the key in price setter control means (48) will cause bypass (400) to pivot on pin (404).

Figure 13:
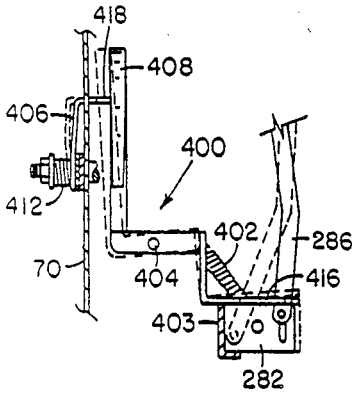
FIG. 13 is a side view of bypass within the coin control mechanism.
Figure 12:
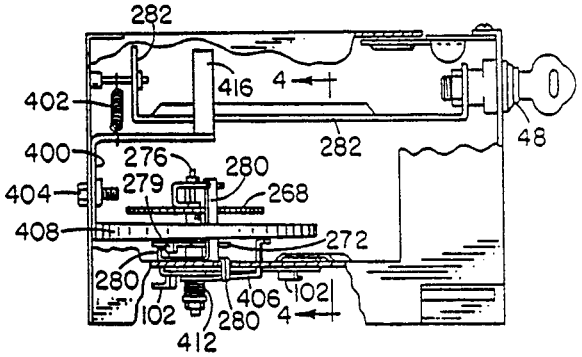
FIG. 12 is a partial cut-away of the top view of the coin control mechanism.
Figure 11:
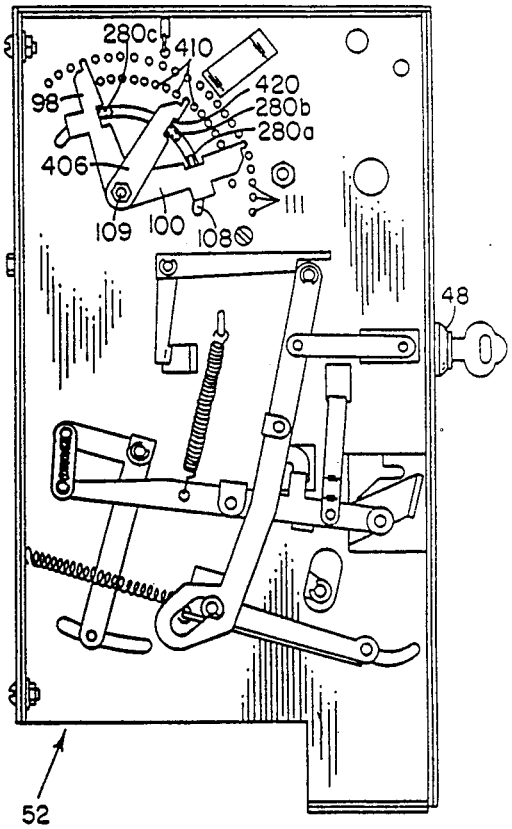
FIG. 11 is a side view of the coin control mechanism.

Generally, this pivoting of bypass (400) raises and lowers adjustable limit means (406) where it contacts curved portion (408) of bypass (400). FIG. 12 illustrates the location of spring (412) that biases adjustable limit means (406) towards a lowered position through apertures (410) and against curved portion (408). As can be seen in FIG. 13, prong (418) of adjustable limit means (406) passes slidably through plate (70) at apertures (410) therein, in much the same manner as adjustable limit means (98) and (100) pass through apertures (111) of the '701 mechanism. A series of apertures (410) is seen in FIG. 11. Adjustable limit means (406) may be manually raised so prong (418) is withdrawn from one aperture (410) and reinserted into a different aperture (410). This change would change the total denomination of coins required to activate coin control mechanism (52), in the same manner that a change in position of limit means (98) or (100) as disclosed in the '701 patent effects such a change.

OPERATION OF BYPASS

Bypass (400) operates in the following manner. Price setter control means (48) may be rotated to one of three positions by use of the key means. Each of the three positions corresponds to one of three different price settings as determined by the position of adjustable limit means (98) and (100) in apertures (111) and adjustable limit means (406) in apertures (410). These three different positions are illustrated in FIG. 11 as (280*a*), (280*b*) and (280*c*). Rotation of price setter control means (48) causes linkage (282) to rotate which in turn moves limit stop (280) to one of the three positions set by limit means (98), (100), and (406) illustrated in FIG. 11 as (280*a*), (280*b*) and (280*c*). Each of these positions corresponds to a different position of totalizer register means (268). For example, position (280*a*), (280*b*) and (280*c*) may correspond to $0.50, $1.00, and $1.25, respectively, in total coinage required to activate coin control mechanism.

FIG. 11 illustrates the positional relationship of limit means (98), (100) and (406). To describe such positions, limit means (98) will alternately be referred to as upper limit means (98), as its position determines, denominationally, the greatest total coinage required to activate coin control mechanism (52). Limit means (100) will alternately be referred to as lower limit means (100), as its position determines, denominationally, the lowest coinage required to activate coin control mechanism (52). Limit means (406) will alternately be referred to as middle limit means (406) as its position determines, denominationally, the coinage required to activate coin control mechanism (52) when such coinage is intermediate between the upper and lower coinage totals.

Middle limit means (406) may be set in any of the stop positions determined by apertures (410), as long as such a stop position is between the position of upper limit means (98) and lower limit means (100).

Figure 15:
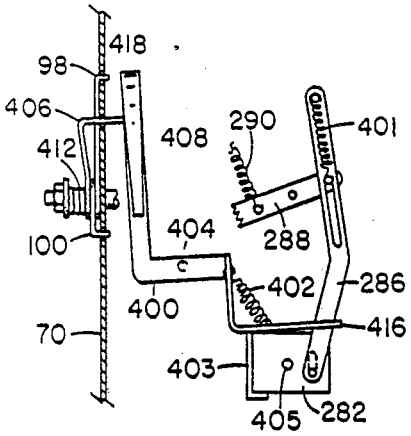
Figure 14:
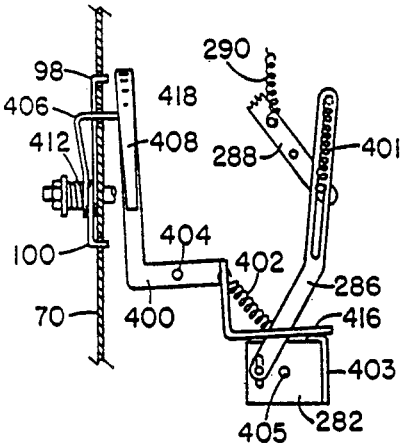

The positions of limit stop (280), denoted (280*a*), (280*b*) and (280*c*) in FIG. 11, correspond to (arbitrarily) a 0°, 90° and 280° position of the key means which operates price setter control means (48). The corresponding position of bypass (400), middle limit means (406) and linkage (282) corresponding to each position of limit stop (280) shown in FIG. 11 as (280*a*), (280*b*) and (280*c*) is illustrated in FIGS. 14, 15 and 16, respectively.

Linkage (282) may be rotated to one of three positions by the key means attached to price setter control means (48). Linkage (282) has wall member (403) and articulates at pin (405). The three different positions of the key means correspond to FIGS. 14, 15 and 16, each figure illustrating the corresponding position of linkage (282) and integral wall member (403). For the sale of the illustration, the position indicated (208*a*) will correspond to a 0° position of key means. In this position bypass spring (402) is "loaded" and biasing interact member (416) of bypass (400) against wall member (403) of linkage (282) as illustrated in FIG. 14. In this position, limit means (406) is elevated sufficiently to allow limit stop (280) to pass beneath it. Position (280*a*) reflects the position of totalizer register means (268), which position determines how far totalizer means must rotate before disengaging the locking means of the dispenser and thereby allowing access to the dispenser.

Figure 16:
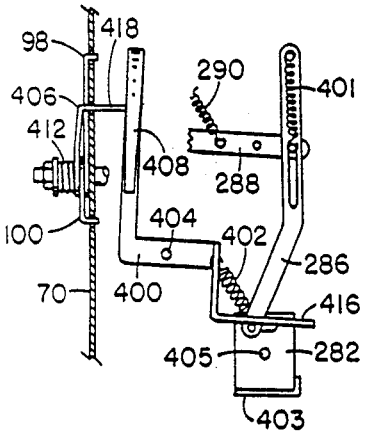
FIGS. 14, 15, and 16 are a front side view with the front plate of the coin control mechanism removed, illustrated in the three positions of the bypass and associated structure.
Figure 17:
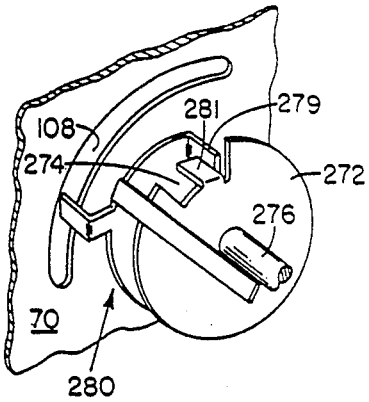
FIG. 17 is a perspective view from within the coin control mechanism of the limit stop.

The rotation of the key means from 0° to 90° results in position of limit stop (280) as set forth in FIG. 11 as (280*b*) and FIG. 16. When the position of bypass (400) is in the position as illustrated in FIG. 16, limit means (406) is urged against curved portion (408) by spring (412), allowing limit means (406) to move to its lowered position from its elevated position. Limit means (406) catches limit stop (280) in notch (420), as limit stop (280) moves toward limit means (98) under the urging of the key means against spring (290) which normally maintains limit stop (280) at position (280*a*). Limit means (406) catches limit stop (280) before the key means and linkage (282) reaches 90°. The key means must be turned with greater torque after the catch as linkage (288) is stationary (because limit stop (280) is stationary against limit means (406)) and the continued rotation of the key means up to the 90° position forces an extension of spring (401). At the 90° position, limit stop (280) is being urged against limit means (406) by spring (401). Simultaneous with the rotation from 0° to 90°, wheels (268) and (272) (which are biased to rotate around stud (276) "follow" limit stop (280). Wheels (268) and (272) move as a unit and are biased, pressing limit plate (281) which is integral with wheel (272) against stop tab (279) projecting from and integral with limit stop (280), as seen in FIG. 17. In other words, as the key is rotated from 0° to 90°, three actions are taking place: limit means (406) is lowering and getting closer to plate (70) at the same time that limit stop (280) is rotating towards limit means (406), and such rotation is allowing wheels (268) and (272) of totalizer register means (268) to "follow along," or rotate therewith.

After the key means is rotated from 0° (280*a*) position to a 90° (280*b*) position, limit stop (280) has come to rest in notch (420) of middle limit means (406). The 90° position of linkage (282), interact member (416) and limit means (406) is as illustrated in FIG. 16. Wheels (268) and (272) of totalizer register means (268) have "followed along" in the manner described above. An intermediate coinage total is now required to activate the dispenser and allow access to the periodicals contained therein.

When the key means is moved from the 90° position to the 180° position, limit stop (280) comes to a rest against limit means (98). Rotation of key to the 180° position moves limit stop (280) to the position indicated by (280*c*) in FIG. 11. The movement of limit stop (280) comes to a rest against limit means stop (280) to the position indicated by (280*c*) in FIG. 11. The movement of limit stop (280) to (280*c*) is initiated and effected in the same manner and through the same linkage as the movement to position (280*b*). In this 180° position, the position of linkage (282), interact member (416) and limit means (406) is as illustrated in FIG. 15, and limit means (406) is being held in an elevated position.

As can be seen in FIGS. 14, 15 and 16 the raising and lowering of limit means (406) in response to the turning of the key means is sufficient to allow enough clearance for limit stop (280) to pass there-beneath when limit means (406) is in the raised position and is low enough to catch limit stop (280) when in its lowered position.

Furthermore, during the rotation from 90° to 180°, wheels (268) and (272) rotate in the same manner as set forth above. The rotation of limit stop (280) from (280*b*) to position (280*c*) occurs when linkage (286) shifts from the position limit stop (280) against limit stop means (406), to a position as illustrated in FIG. 16, where spring (401) is biasing limit stop (280) against limit stop means (406), to a position as illustrated in FIG. 15 where spring (401) is still biasing limit stop (280) in a clockwise direction but limit stop is now flush against limit stop means (98). The raising of limit means (406) allows the movement of limit stop (280) thereunder and up to limit stop means (98). The force required to urge such biasing and maintain pressure originates at spring (401) and is transmitted through elements (288) and (278) to limit stop (280).

At the 180° position of the key means and linkages (282) and (296), limit stop (280) rests against limit stop means (98). The movement of wheels (268) and (272) of totalizer register means (268) has changed the position of notch portion (274) with respect to element (218). In other words, as the key means is rotated from 90° to 180°, three actions are taking place. Limit means (406) is raising, limit stop (280) is then released and moves towards limit means (98), while, simultaneously, wheels (268) and (272) are rotating and changing position of totalizer register means (268).

For limit stop (280) to return to 180° (280*c*) to 0° (280*a*), the key means is rotated back to the 0° position. This rotation results in the following actions. First, it allows limit means (406) to lower as wall member (403) rotates away from interact member (416) and permits springs (412) and (402) to compress. This catches limit stop (280) against the back side of limit means (406) (opposite notch (420)). Then, as the 0° position is being approached, wall member (403) contacts interact member (416), rotates bypass (400) and raises limit means (406), allowing limit stop (280) to freely rotate back to the 0° (280*a*) position.

Thus, it is seen how the use of bypass (400), a three-position key means, limit means (406), and the related structure set forth herein allows a rapid change of the coin control mechanism to one of three different coin denominational totals to activate the dispenser.

Figure 18:
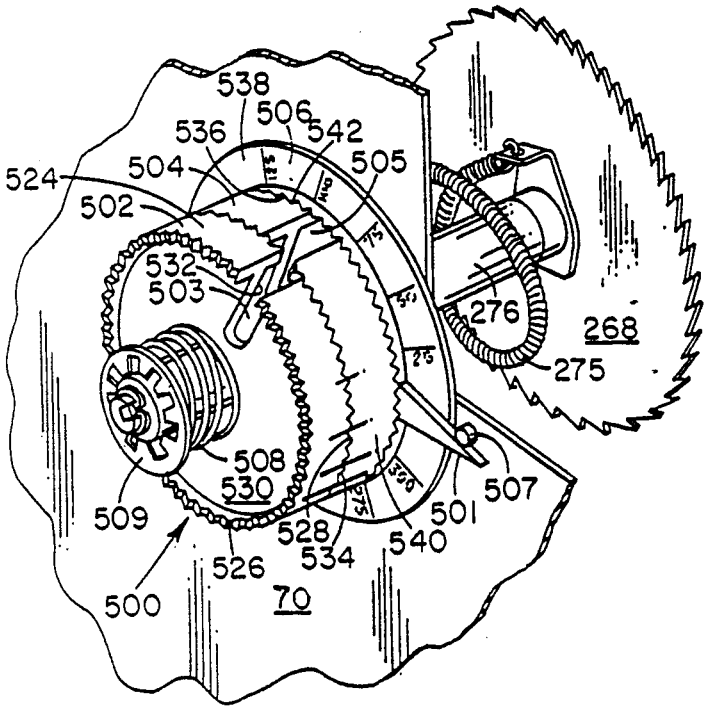
FIG. 18 is a perspective of the slotted rings of the price control unit.
Figure 19:
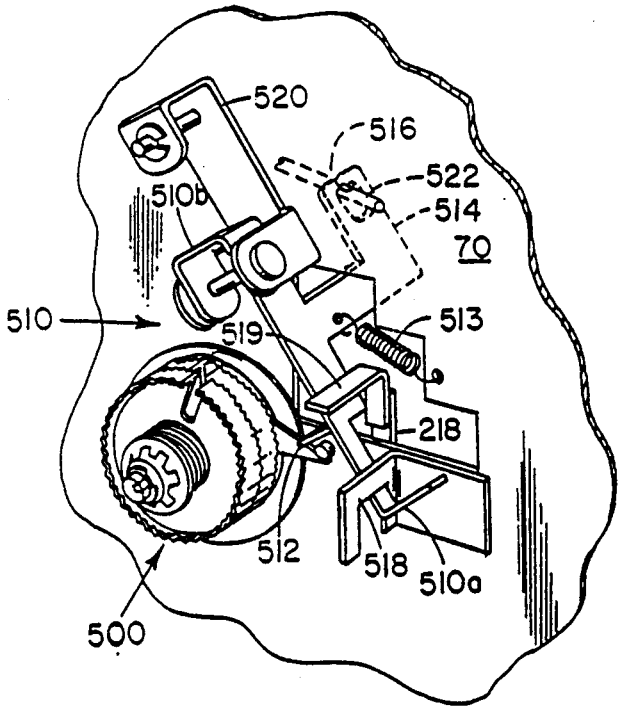
FIG. 19 is a perspective of the price control unit showing the slotted rings and the release bar.

A preferred embodiment of the invention replaces various components of the '701 patent a split ring assembly (500), and release bar (510) and structure associated therewith as shown in FIGS. 18 and 19. Specifically, the structure in the '701 patent which is replaced is: wheel (272), adjustable limit means (98) and (100), limit stop (280), mounting member (278), apertures (111), and stud or pin (109).

FIG. 18 is a perspective of the slotted split rings of the price control unit apart from the coin control mechanism. As can be seen in FIG. 18, split ring assembly (500) is comprised of three main parts, top ring (502), extending through outer annulus (524), which has serrated or bitted circumferencial ridges (526) and (528) along the upper and lower perimeter thereof. Top ring (502) also has top face (530) and bottom face (532). Bottom ring (504) has bottom ring slot (505) extending through outer annulus (540), which has serrated or bitted circumferencial serrated ridges (534) and (536) along the upper and lower perimeter thereof.

Base plate (506) is generally planar and lies generally flush against coin mechanism mounting plate (70). Base plate (506) has plate stop (501) integral therewith and projecting therefrom, which contacts peg stop (507), which is mounted on mounting plate (70), when base plate (506) rotates. Base plate (506) contains an annular ring of serrated ridges (542) on top face (538) thereof. Base plate (506) is rigidly mounted to stud 276 which extends through mounting plate (70) and to which wheel (268) of the totalizer is also fixedly attached. Wheel (268), base plate (506), top ring (502) and bottom ring (504) are biased in a counterclockwise direction by bias means (275) coupled to wheel (268) for rotating on stud (276). Therefore, wheel (268), base plate (506), top ring (502) and bottom ring (504) move synchronously as one and are normally biased in the counterclockwise direction.

Spring (508) and spring fastener (509) bias top ring (502) against bottom ring (504) and base plate (506). Since the bits on serrated ridges (526), (528), (534), (536) and (542) match, spring (508) will normally lock the three so split ring assembly (500) may move as a unit.

FIGS. 19 through 22 show a perspective of the price control unit showing rings (502) and (504) and release bar (510), a side view of release bar (510) in a lowered position, a side view of release bar (510) in a raised position, and a perspective view from within the coin control mechanism of release bar (510).

Release bar (510) is comprised of release bar prong (512), release bar member (514), and release bar slot (516). Release bar (510) is movable so it may be located in one of four positions, depending upon position of the key and the position of dispenser activator (218). The four positions, by location of release bar (510) with respect to plate (70) and rings (502) and (504) are: raised and open, lowered and open, raised and closed, and lowered and closed. The terms "raised" and "lowered" refer to the position of far end (510*a*) of release bar (510). The terms "open" and "closed" refer to the position of far end (510*a*) either away from or against split ring assembly (500).

Figure 20:
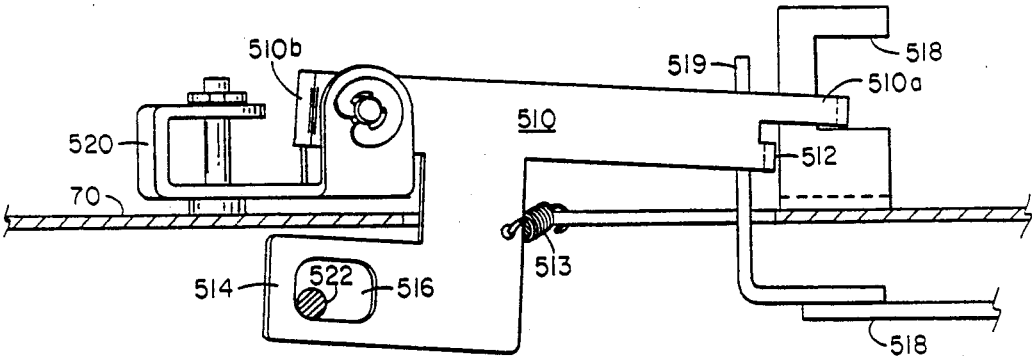
FIG. 20 is a side view of the release bar mechanism with the release bar in a lowered position.
Figure 21:
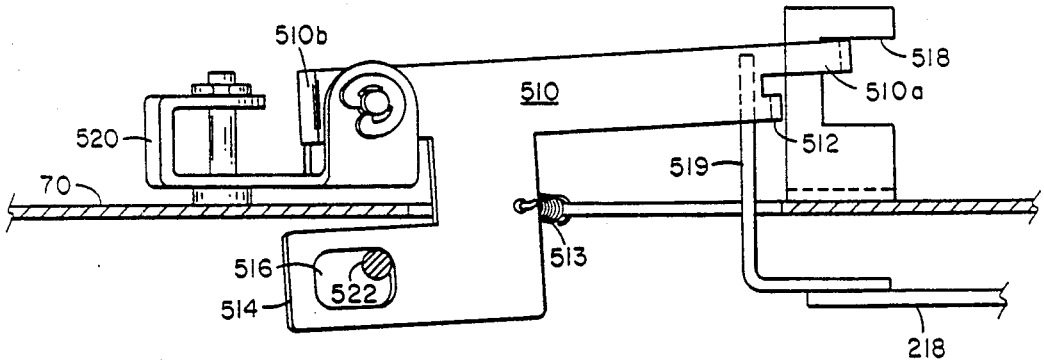
FIG. 21 is a side view of the release bar mechanism with the release bar in a raised position.
Figure 22:
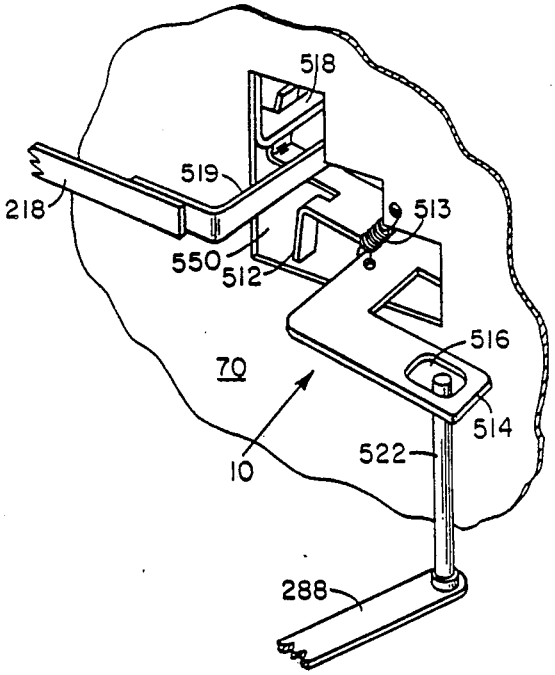
FIG. 22 is a perspective view from within the coin control mechanism of the release bar mechanism.
Figure 23:
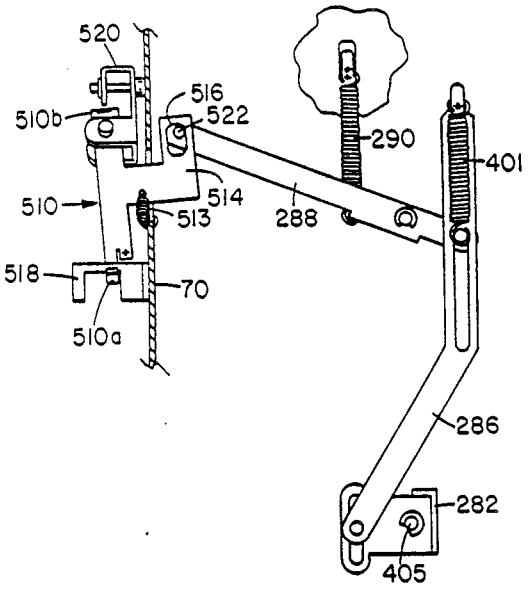
FIG. 23 is a cut-away side view of the release bar mechanism illustrating the release bar in a lowered position.
Figure 24:
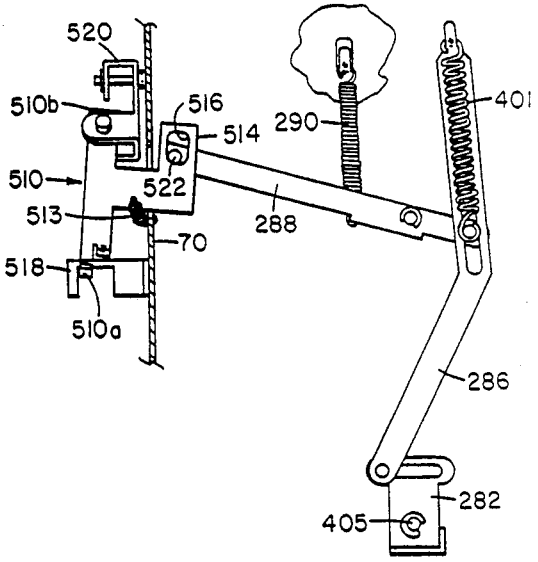
FIG. 24 is a cut-away side view of the release bar mechanism illustrating the release bar in a raised position.

The raised position can be seen illustrated in FIG. 21 and the lowered position in FIG. 20. When the release bar is closed, it is flush against split ring assembly (500); and when it is open, it is away from split ring assembly (500) and against release bar stop (518). In the manner more fully set forth below when the key is in a 0° position (arbitrarily chosen), corresponding to a lower limit of coin totals required to activate the dispenser, far end (510*a*) is in a raised position as illustrated in FIG. 21 and 24, and is lying generally in the plane of top ring (502). When the key is rotated to 90° far end (510*a*), moves to a lowered position as illustrated in FIG. 20 and 23, and is lying generally in the plane of bottom ring (504). Near end (510*b*) of release bar (510) is attached to release bar gimbal (520), and release bar (510) is free to pivot in the plane of mounting plate (70). In addition, release bar (510) can pivot vertically away from mounting plate (70) from the point where it attaches to gimbal (520).

Also illustrated in FIGS. 19 and 20 is dispenser actuator extend (519). Release bar bias spring (513) will normally bias release bar (510) against release bar stop (518) which is mounted on mounting plate (70). Extending through opening (550) (FIG. 22) in mounting plate (70) is release bar member (514) which contains release bar slot (516) therein. Release bar interconnect (522) extends perpendicular from interconnect (286) to engage release bar (510).

FIGS. 23 and 24 are included to illustrate the manner in which release bar (510) and the structure associated therewith engages the structure of the '701 patent. More specifically, it can be seen how linkages (282), (286) and (288), spring bias means (290), spring (501) and pin (505) are generally the same as disclosed the parent patent. However, instead of linkage (288) connecting to mounting member (278) as is disclosed in the '701 patent, linkage (288) is coupled to release bar (510) through interconnect (522).

Split ring assembly (500) allows the vendor to choose between two different coin totals required to activate the dispensing machine and allow access to the merchandise contained therein. After the totals are set at an upper limit and a lower limit by rotation of the split ring assembly (500) as described more fully below, coin control mechanism (52) may be then quickly changed from the outside between the upper limit and the lower limit by rotating the key.

Split ring assembly (500) and release bar (510) allow the operator to quickly change and preset the dispensing position of the totalizer at any one of a plurality of positions. These positions set an upper limit coin total and a lower limit coin total required to activate the dispensing machine.

The upper limit will reflect a larger total value of coins that will allow access to the machine then the lower limit. To set these limits, the vendor may position split ring assembly (500) so the dispensing position of the totalizer is set at an upper limit reflecting a denomination value of (for example) $1.50 and the lower limit reflecting a coin denomination value of (for example) $0.25. Thereafter, a quick change between these two limit positions may be made by the vendor from the outside of the machine through the use of a key.

The rotation of the key rotates the interconnect member (282) and transfer that rotation through linkage (286) to linkage (288) as illustrated in FIGS. 23 and 24. However, unlike the '701 patent in which linkage (288) actuates mounting member (278), here linkage (288) connected to release bar interconnect (522) and movement of linkage (288) is therefore translated to release bar (510).

When the key is at 0° (arbitrarily chosen) as shown in FIG. 23, interconnect member (282) is positioned as illustrated. Linkage (286) maintains the location of linkage (288) through the bias of spring (501). In this first position, release bar member (510) is in the lower position as shown in FIG. 20 such that far end (510*a*) release bar prong (512) is aligned with bottom ring (504).

When the key is rotated 90° interconnect member (282) is positioned as illustrated in FIG. 24. Such rotation shifts linkage (286), actuating interconnect linkage (288), which pivots far end (510*a*) to a raised position as illustrated in FIG. 21, through the action of release bar interconnect (522). Because linkage (288) is fixedly connected to release bar interconnect (522), release bar (510) is allowed to change between the raised position (FIG. 21) and the lowered position (FIG. 20).

Dispenser actuator extend (519) is biased clockwise against release bar (510) by bias spring (234), and causes release bar prong (512) of release bar (510) to press against split ring assembly (500) when the coin control mechanism (52) is in a locked, non-dispensing position.

The preset non-dispensing position of the totalizer is fixed by the position of plate stop (501) as it rests against peg stop (507). As coins are placed into the coin chute and activate the totalizer, the totalizer begins advancing towards the dispensing position. Split ring assembly (500) advances along with the totalizer. As this occurs, both top ring slot (503) and bottom ring slot (505) approach release bar prong (512). If the key is in the first position (0° ), release bar (510) will be in a lower position (FIG. 20 and 23) and release bar prong (512) will ultimately engage bottom ring slot (505). On the other hand, if the key is in the second position (90° ), release bar (510) will be in a raised position (FIG. 21 and 24), and release bar prong (512) will ultimately engage top ring slot (503). In either case, when release bar prong (512) enters a slot (503 or (505), dispenser actuator (218) will release mechanism, allowing access to the dispenser.

Two different dispensing positions, representing upper and lower coin value totals, may be set by the vendor by raising top ring (502) and/or bottom ring (504) away from base plate (506) and repositioning slots (503) and (505) with respect to base plate (506) while allowing plate stop (501) to rest against peg stop (507) (the non-dispensing position of totalizer). Base plate (506) is preferably marked with denominations (see FIG. 18) illustrating the positions over which either slot (403 or (505)) may be set. For example, bottom ring slot (505) may be set over the "50" position which represents coins totalling $0.50. At the same time, the operator may raise top ring (502) and twist it so top ring slot (503) is above the "100" mark on base plate (506). The operator has thereby quickly and easily set a lower limit of totalizer at $0.50 and an upper limit of totalizer at $1.00.

Figure 1:
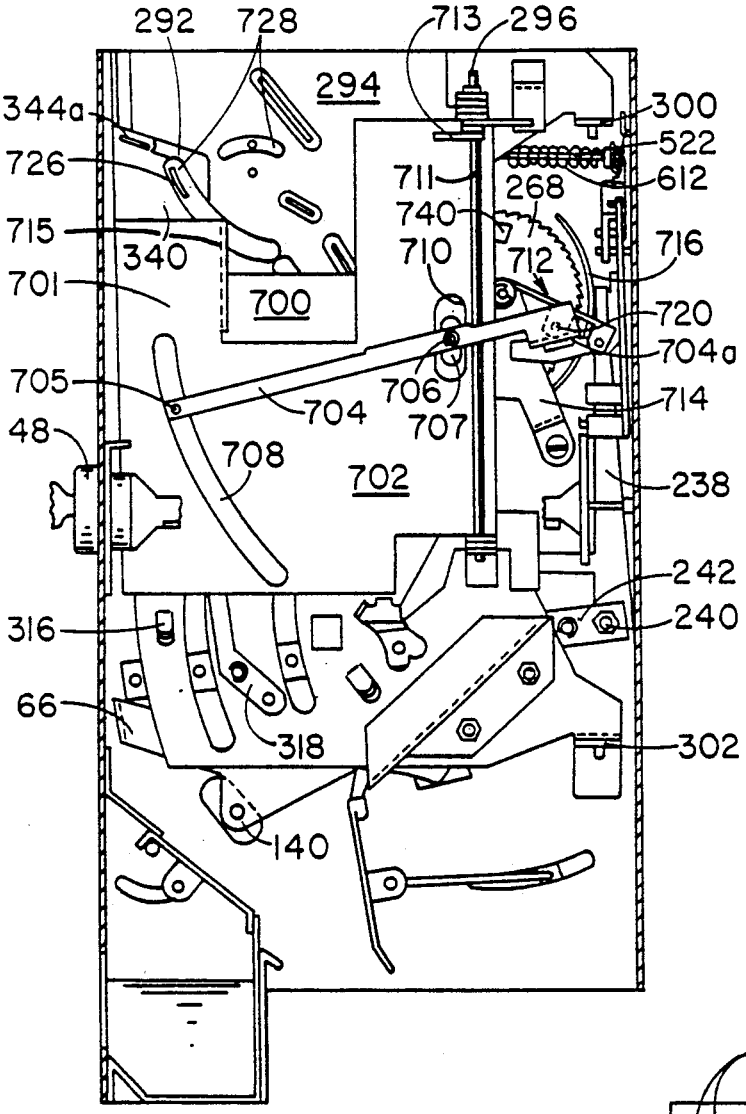
FIG. 1 is a side elevational view of the coin control mechanism cut away to show the secondary coin chute.
Figure 5:
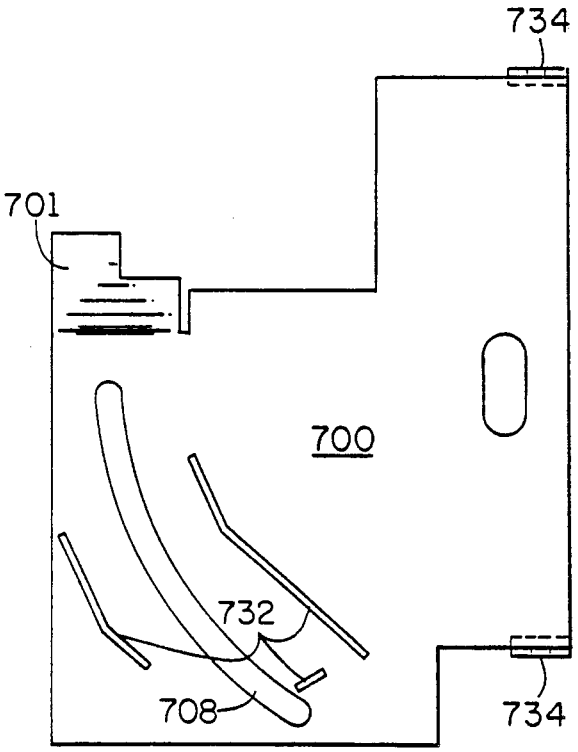
FIG. 5 is a side elevational view of the third coin chute plate.
Figure 6:
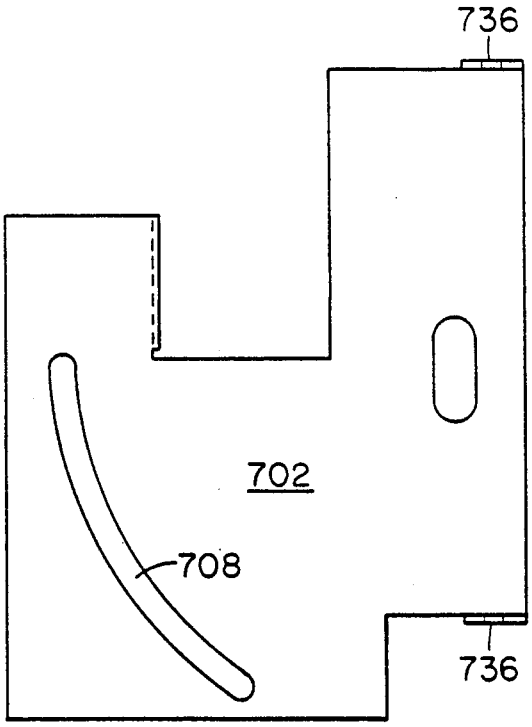
FIG. 6 is a side elevational view of the fourth coin chute plate.
Figure 7:
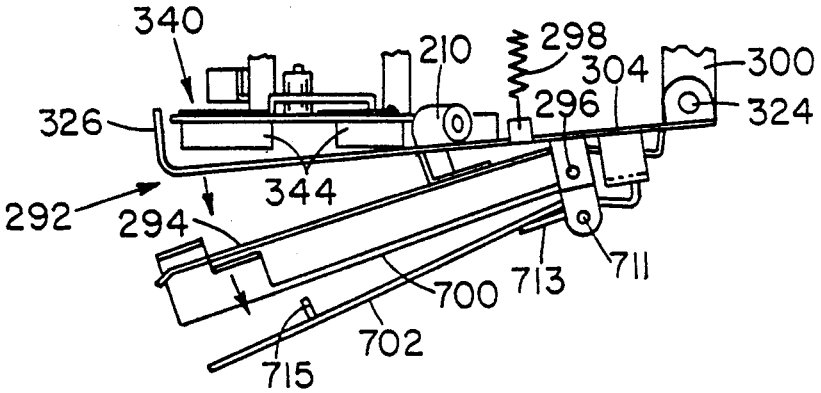
FIG. 7 is a top view of the primary and secondary coin chutes.
Figure 7A:
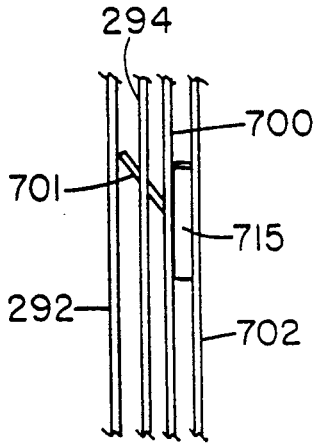
FIG. 7A is a front view of the primary and secondary coin chutes with other parts deleted for clarity.

With reference to FIGS. 1, 7, and 7A, it can be seen that this invention adds to Knickerbocker third and fourth coin chute plates (700) and (702), respectively, which plates are made up of substantially flat elements, which lie in planes substantially parallel to each other, which planes which are also generally parallel to the base plate (340), first coin chute plate (292), and second coin chute plate (294). As can be seen in FIGS. 7 and 7A, plates (700) and (702) form a secondary coin chute with bent or ramp portion (701) of coin chute plate (700) communicating with the first or primary coin chute defined by plates (292) and (294). That is, third coin chute plate (702) as shown in FIGS. 5 and 6, lies in substantially parallel relation to form a secondary coin chute which lies adjacent to the primary coin chute as defined by first coin chute plate (292) (see FIG. 3) and second coin chute plate (294); (see FIG. 4). The first coin chute or primary coin chute is more specifically described in the '701 patent and is designed to receive and allow passage therethrough, coins of nickel, dime and quarter denominations. However, with the addition of the third and fourth coin chute plates forming a secondary coin chute, which coin chute is designed to receive one dollar coins such as the Susan B. Anthony coin or the Loon dollar, and to operatively engage the totalizer means as more fully set forth below, the Knickerbocker mechanism can be adapted to receive coins of four different denominations. One advantage to this secondary coin chute is its ability to be incorporated within the existing mechanisms that are generally described in the Knickerbocker patent.

In general, and with reference to FIGS. 1 and 7, it can be seen that as the dollar coin falls through the secondary coin chute, it activates lever arm (704) which articulates at pin (706). Pin (706) is mounted on stud (707) which stud extends through all the coin chute plates through opening (710), which lever arm (704) causes engagement of ratchet mechanism (712) with totalizer (268) in a manner more fully set forth below.

Lever arm (704) rotates through lever arm slot (708) which slot extends through third coin chute plate (704) and fourth coin chute plate (702) (see FIGS. 5 and 6). Shaft (711) and bias means (713) maintain pressure against fourth coin chute plate (702) as seen in FIGS. 1 and 7. Wall member (715) of fourth coin chute plate (702) maintains separation between chutes (700) and (702), which separation is sufficiently great to allow a dollar coin to slide easily therebetween. Wall member (715) also acts as a coin guide in the manner of coin guides (344).

Figure 1A:
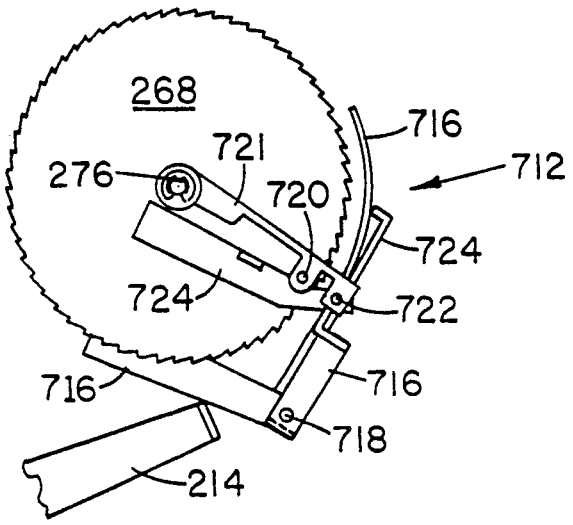
FIG. 1A is an elevational view of the totalizer and ratchet mechanism apart from the coin control mechanism.
Figure 1B:
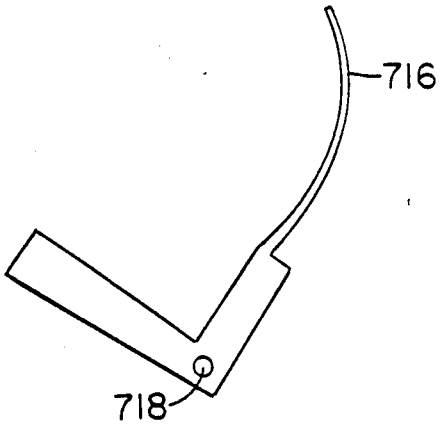
FIG. 1B is a front elevational view of the release element apart from the coin control mechanism.
Figure 1C:
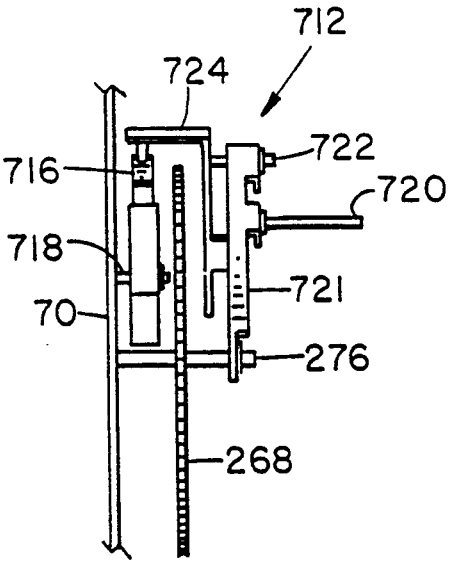
FIG. 1C is a top view of the totalizer means and ratchet mechanism.

Details of ratchet mechanism (712) are more fully illustrated in FIGS. 1A, 1B, and 1C. More particularly, ratchet mechanism (712) is designed to engage and disengage ratchet (268) through the action of release tab (214) which acts in a manner as more fully set forth in the '701 patent. Member (716) articulates on pin (718) which is in turn mounted to wall (70), and allows release tab (214) to engage and disengage ratchet means with ratchet (268). Ratchet means contains base (721) which articulates on stud (276), and drive pawl (724) which is designed and dimensioned to operatively engage member (716) as well as totalizer wheel (268).

With the door of the dispensing machine shut, the insertion of coins into the vending machine will cause pivoting of lever (242) as the nickels, dimes, and quarters drop through the primary chute, and pivoting of lever arm (704) as dollar coins drop through the secondary chute. Both of these actions will cause totalizer means to move from its non-dispensing position to a predetermined dispensing position which position reflects the total denomination of coins required to activate the latch means and allow access to the periodical dispenser.

Figure 8:
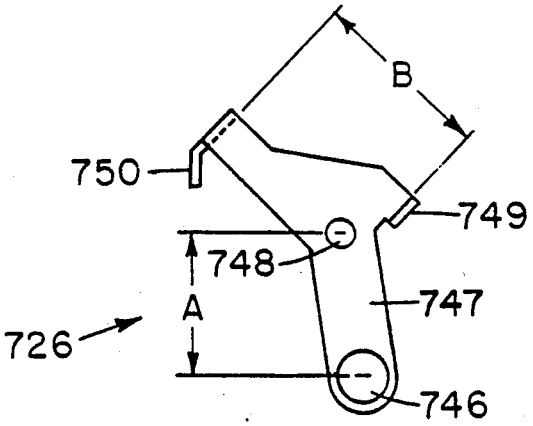
FIG. 8 is a side elevation view of the dollar cradle means, apart from the mechanism.

FIG. 1 illustrates the addition of a third cradle means (726) at the top of the primary coin chute which acts through slots (728) in base plate (340), first coin chute plate (292) and second coin chute plate (294). Cradle means (726) is biased by counterweight (746) which lies outboard on cradle arm (747). Cradle means (726) pivots at pivot bushing (748) when catch tabs (749 and 750) engage coins inserted through slot (56) of coin control mechanism. Both U.S. and Canadian dollar coins have diameters greater than the linear distance between catch tabs (749) and (750), as seen in FIG. 8 as B, and upon engaging cradle means (726), will cause it to rotate in a counterclockwise direction from its rest position to an angular position just vertically above ramp portion (701) of third coin chute plate (700). Nickels, dimes, and quarters, however, have a diameter less than the distance between catch tabs (749) and (750) and will only engage catch tab (750) as they roll off coin guide (344*a*) and will continue in a path to engage the remaining cradle means as set forth in the '701 patent. Mounting brace (714) is fixedly attached to wall (70) and is used to brace stud (707).

Coin guide (344*a*) guides all coins inserted through slot (56) through cradle means (726), which cradle is mounted on base plate (340) in the same manner as cradle means (346), which cradle is designed to be rotated counterclockwise and pitch the dollar coins into the front of the primary coin chute where they will fall under the impetus of gravity onto bent/ramp portion (701). Ramp portion (701) in turn guides the dollar coins into the secondary coin chute. Thereupon, the dollar coins engage the pin mounted on lever arm (704) in a manner as more fully set forth above.

Figure 2:
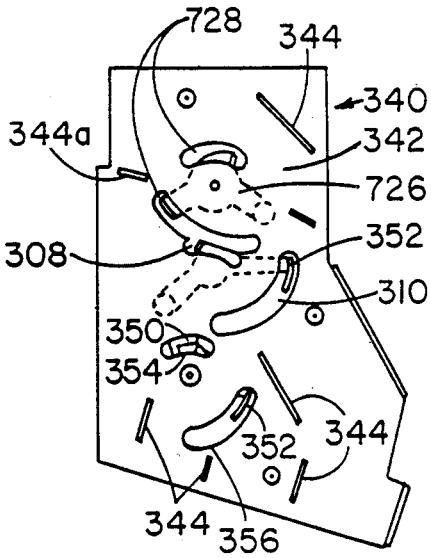
FIG. 2 is a side elevational view of the base plate.
Figure 10:
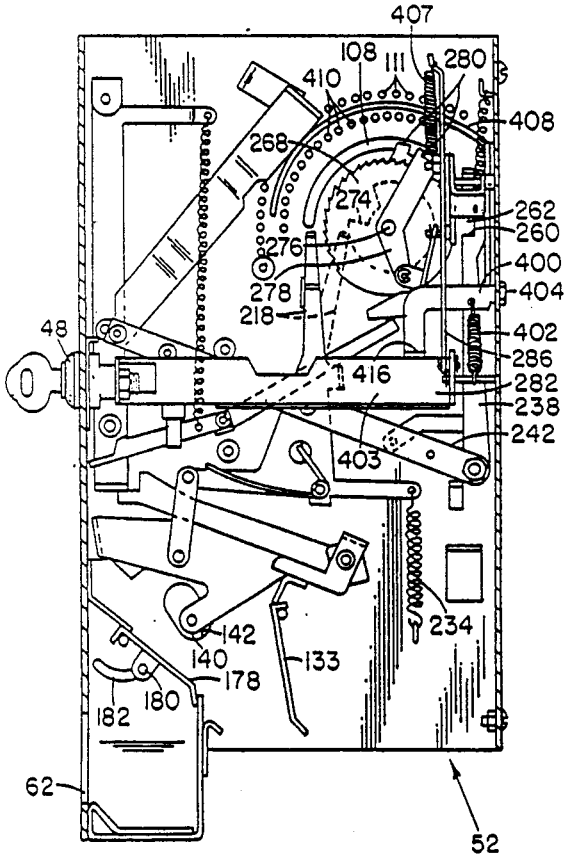
FIG. 10 is a side view of the slide control mechanism with the chute means removed.

FIG. 2 is best viewed in conjunction with FIGS. 9 and 10 of the '701 patent. It can be seen that coin guide designated herein as (344*a*) corresponds to, but is shorter than the corresponding coin guide (344) in FIG. 9 of the Knickerbocker patent. That is, due to the addition of cradle means (726) to the primary coin chute, a shorter coin guide (344*a*) is required. FIG. 2 also illustrates that the manner in which cradle (726) is mounted to base plate (340) is the same manner as the mounting of cradle means (346). However, whereas cradle means (346) rotate in a clockwise direction to deposit their respective coins in the proper channels within the primary coin chute, dollar cradle means (726) rotates in a counterclockwise manner to deposit the dollar coin in the upper left-hand portion (as viewed in FIG. 1) of the primary coin chute, whereupon it engages bent portion (701).

Figure 3:
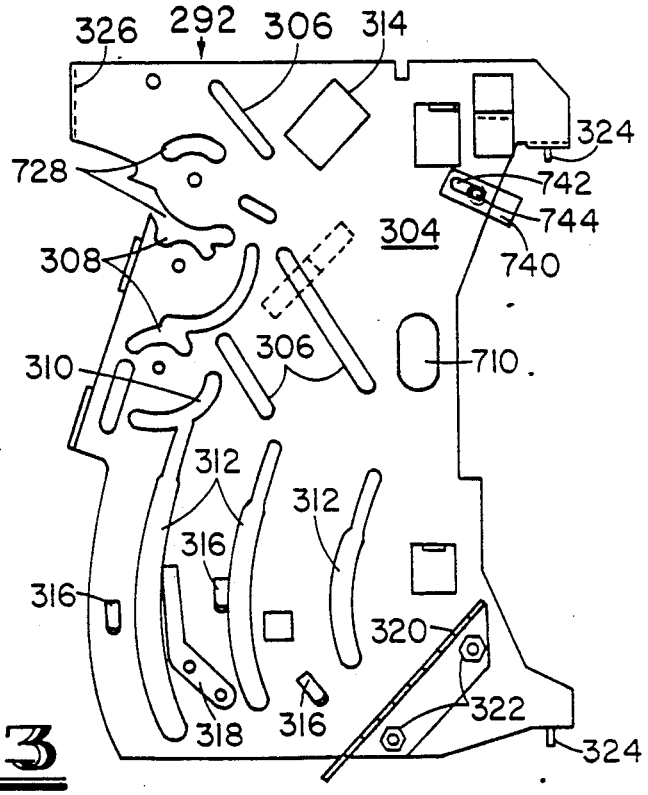
FIG. 3 is a side elevational view of the first coin chute plate.

As can be seen in FIGS. 2 and 3—FIG. 3 generally corresponding to FIG. 11 of the '701 patent—slots (728) through which cradle means (726) partially extends, are provided in base plate (340), and in first coin chute plate (292). As can be seen in FIGS. 2 and 3, coin slots (728) have an upper and lower portion thereof. The lower portion fuses with upper slot (308). The actuator arm slots (312), as illustrated in FIG. 3, are functionally similar to the actuator arm slot (708) in plates (700) and (702), but engage nickels, dimes, and quarters rather than the dollar coins.

Figure 4:
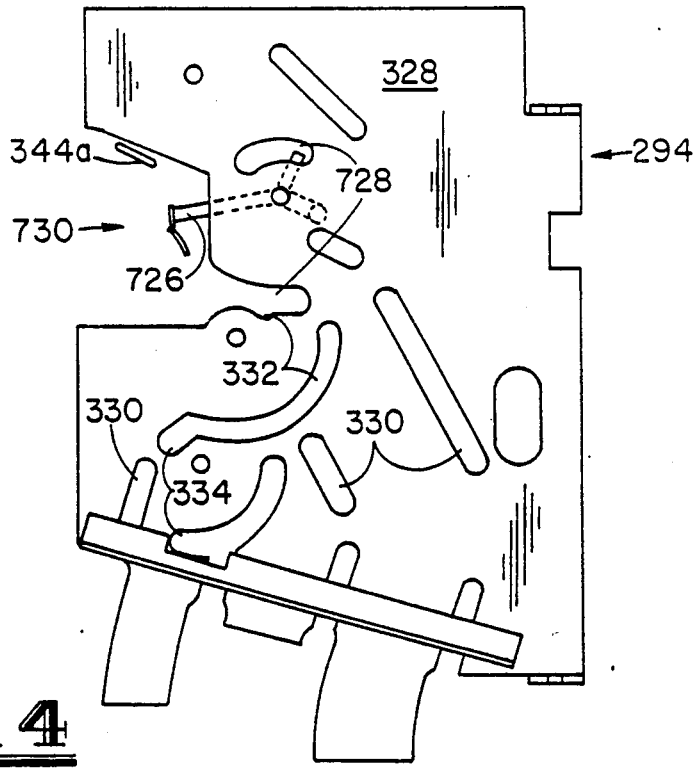
FIG. 4 is a side elevational view of the second coin chute plate.

Stop plate (740), as seen in FIG. 4, has slot (742) therein and means (744) to fasten it to first coin chute plate (292). Stop plate (740) is positioned near the top of first coin chute plate (292) so as to engage arm (720) after lever arm (704) completes its swing through a counterclockwise arc in response to passage of coins through the secondary coin chute. That is, as lever arm (704) stops abruptly with pin (705) striking the bottom of lever arm slot (708), the momentum of ratchet means (712) and arm (720) may tend to carry ratchet means (712) beyond the arc defined by the travel of lever (704) which arc corresponds to a dollar movement of totalizer toward the dispensing position. However, by adjusting stop plate (740) to intercept arm (720) just as it moves, under momentum, off the end of lever (704), any excess movement of the totalizer is prevented.

FIGS. 3 and 4 show separate views of first coin chute plate (292) and (294). FIG. 4 corresponds generally with FIG. 12 of the '701 patent. However, second coin chute plate (294) contains cutout portion (730) which is required to allow entry of bent portion (701) into the primary coin chute. Cutout portion (730) is sized to allow coin guide (344*a*) to enter the primary coin chute as indicated in FIG. 4. FIG. 4 also illustrates upper and lower cradle slots (332) and (334), respectively, and actuator arm slots (336) corresponding to those in first coin chute plate (292).

FIGS. 5 and 6 illustrate third coin chute plate (700) and fourth coin chute plate (702). These contain lever arm slot (708) and coin guide (732). Coin guide (732) defines a channel to direct dollar coins through the secondary coin chute. A lever arm slot is positioned within the channel to allow for lever arm pin (705) to engage the dollar coin. Plate (700) is secured by tabs (734) to shaft (296) for rotation thereon in the same manner as second coin chute plate (294) and is affixed to the same shaft. Tabs (736) on fourth coin chute plate (702) are bent generally perpendicular to the plane in which fourth coin chute (702) lies and are pivotally mounted on shaft (711). Such pivotal mounting allows all the coin chute plates to rotate in the manner as set forth in FIG. 7 when the coin return feature is used. More particularly, the mechanism as described above allows for articulation of both the first and second coin chute plates away from their alignment with the coin slot, and for the third and fourth coin chute plates to pivot away from the primary coin chute. This feature allows for the release of jammed coins. This rotation is illustrated in FIG. 7, which shows the position of respective coin chute plates during activation of the coin return mechanism. The coin return mechanism engages the plates at cam (210) as more fully set forth in the '701 patent.

OPERATION

Nickel, dime, quarter, and one dollar coins are inserted through slot (56). Access to the machine is controlled by the totalizer which calculates the cumulative total coins registered by the coin control mechanism. As the coins engage cradle means (726), nickel, dime, and quarter coins pass through and into their respective coin passages within the primary coin chute. The actuator control assembly provided in the '701 patent advances ratchet (286) of the totalizer towards a predetermined engagement position, which engagement position reflects the total value of the denomination of coins required to allow access to the periodical machine. Such a predetermined maximum for the dispensing position can be controlled by the vendor as more fully set forth in the '701 patent and the applications incorporated herein by reference. However, as the dollar coins engage cradle means (726), they are diverted into the forward portion of the primary coin chute by the counter-clockwise rotation of the cradle means. As the dollar coins fall in the plane of the primary chute, they are intercepted by a ramp portion (701) and diverted into the secondary coin chute. At the top portion of the secondary coin chute the dollar coins engage pin (705) of lever arm (704) and begin the counter-clockwise rotation thereof. In the coin channel defined by coin guides (732), the dollar will continue its passage through the secondary coin chute, carrying along with it lever arm (704). As lever arm (704) rotates in a counter-clockwise position, it causes the rotation of ratchet means (712), which engages lever arm (704) through arm (720). As can be seen in FIG. 1, lever arm (704) is counter-weighed by counter weight (704*a*) to be normally biased in a clockwise position and to rest in a normal position at the top of lever arm slot (708), until engaged by the passage of the dollar coin through the secondary coin chute.

With the door of the periodical dispensing machine shut, member (716) will be in a withdrawn position allowing for member (238) and ratchet means (716) to lie against register means (268). Therefore, as coins pass through the primary and secondary chutes, the ratchet wheel is advanced from a pre-dispensing to a dispensing position. When the dispensing position is reached, the latch means will allow the opening of the door and the totalizer means will re-set itself to the pre-engaged position.

DIMENSIONS

One of the features of this invention is that it is adapted to fit within the coin control mechanism as generally described in the '701 patent. The addition of dollar cradle means (726) to the primary coin chute does not necessitate a substantial change in the overall dimensions of base plate (34), first coin chute (292) or second coin chute plate (294). Of course, as set forth above, second coin chute plate (294) must have a cutout therein for receipt of ramp portion (701) of third coin chute plate (700). The preferred dimension of both third and fourth coin chute plates (700 and 702) is about six inches (6") in height and four inches (4") in width. The preferred width between the two plates is about three thirty-seconds of an inch (3/32").

Coin slot (56) is limited to about 1.049" in height. This allows for the passage of U.S. and Canadian dollar coins—both about 1.042" in diameter—to pass through, but will keep out the U.S. half-dollar coin. The dollar cradle dimension, as indicated in FIG. 8, is 0.985" across catch tabs. This distance is sufficient to grab the U.S. and Canadian one-dollar coins but pass the coins of smaller denominations. A weight of just under 2.5 grams is attached at about 0.812" from the center of rotation as shown in FIG. 8, denoted A. Cradle means (726) is formed from 18-gauge cold rolled steel.

Although the invention has been described in connection with the preferred embodiment, it is not intended to limit the invention to the particular form set forth, but on the contrary, it is intended to cover such alternatives, modifications, and equivalents as may be included within the spirit and scope of the invention as defined by the appended claims.

I claim:

1. A coin control mechanism for controlling access to a dispensing machine, said dispensing machine including access means and latch means for locking said access means in a closed position, said coin mechanism comprising:

first coin chute means capable of allowing the receipt and passage of nickel, dime, and quarter denomination coins therethrough and further capable of allowing the receipt of one dollar denomination coins:

second coin chute means capable of allowing the passage of one dollar coins therethrough;

weight and size responsive diverting means in operative association with said first and second coin chute means for diverting the dollar coins from said first coin chute means into said second coin chute means while allowing the passage of nickel, dime and quarter denomination coins therethrough;

means for totalizing the value of coins passing through said first and said second coin chute means;

actuator means operatively connected to said totalizing means for releasing said latch means when a predetermined value of coins has passed through said first and said second coin chute means;

means for selecting said predetermined value from an upper value, a middle value, and a lower value;

a limit stop movable between an upper limit member, a middle limit member, and a lower limit member, corresponding to said upper value, said middle value and said lower value, respectively, said limit stop being connected to said totalizing means; and adjustment means for moving said limit stop to one of said limit members;

said adjustment means comprising a linkage member coupled to said limit stop, whereby rotation of said linkage member causes said limit stop to move between said limit members;

wherein said linkage member is further connected to lock means mounted on the outside of said dispensing machine, whereby movement of said lock means to a first angular position causes said limit stop to move to said upper limit member, movement of said lock means to a second angular position causes said limit stop to move to said middle limit member, and movement of said lock means to a third angular position causes said limit stop to move to said lower limit member, thus allowing quick adjustment in said coin mechanism between said upper, said middle, and said lower values.

2. The device as described in claim 1 wherein said diverting means includes cradle means and deflector means, wherein said cradle means, in a first angular position engages nickel, dime, quarter, and dollar coins and rotates in response to receipt thereof to a second angular position for the dollar coin and to a third angular position for the nickel, dime, and quarter coins, allowing said coins to drop downward off said cradle means, wherein said deflector means engages said first coin chute means vertically below said second angular position to intercept the dollar coins and direct them into said second coin chute means, and said nickel, dime, and quarter coins fall through said first coin chute means.

3. The device as described in claim 1 wherein said first coin chute means and said second coin chute means lie in generally parallel, vertical planes.

4. The device as described in claim 3 further comprising an articulation means, which articulation means allows the rotation of said first and said second coin chute means from said parallel planes to substantially non-parallel planes, said articulation means further comprising a bias means to maintain said first coin chute means and said second coin chute means in said parallel planes.

5. The device as described in claim 2 wherein said actuation means contains a first lever and a second lever, said first lever in operative association with said first coin chute means and said second lever in operative association with said second coin chute means, said levers being responsive to the passage of coins to advance the totalizer from a predispensing position to a dispensing position.

6. The device as described in claim 5 wherein:

said first lever has a first end and a second end, with a rotation pin therebetween, said first end having an engagement pin and said second end having a ratchet means, said engagement pin for engaging the coins as they pass through said first coin chute means and said ratchet means for engaging and advancing the totalizer as the coins rotate said first lever;

said second lever has a first end and a second end, with a rotation pin therebetween, said first end having an engagement pin and said second end having a ratchet means, said engagement pin for engaging the coins as they pass through said second coin chute means and said ratchet means for engaging and advancing the totalizer as the coins rotate said second lever;

wherein said actuator means incrementally advances said totalizer from a nondispensing position to a dispensing position in response to the passage of said coins through said first and said second chute means, said dispensing position allowing access to the periodical dispensing machine.

7. The device as described in claim 2 wherein said first coin chute means is disposed vertically below the coin slot.

8. The device as described in claim 2 wherein each of said first and said second coin chute means has the following dimensions: about six inches (6") in height and four inches (4") in width, and having a thickness of about one-quarter inch ($\frac{1}{4}$").

* * * * *